United States Patent [19]

Momoi

[11] 3,995,898

[45] Dec. 7, 1976

[54] METHOD FOR MANUFACTURING FISHING NET

[75] Inventor: Atsushi Momoi, Akaho, Japan

[73] Assignee: Momoi Fishing Net Mfg., Ltd., Hyogo, Japan

[22] Filed: Jan. 22, 1976

[21] Appl. No.: 651,404

[52] U.S. Cl. ..... 289/1.5; 87/12

[51] Int. Cl.[2] ..... B65H 69/04

[58] Field of Search ..... 289/1.2, 1.5, 18; 87/12, 53

[56] References Cited

UNITED STATES PATENTS

| | | | |
|---|---|---|---|
| 2,619,704 | 12/1952 | Frontel | 289/1.5 X |
| 2,641,951 | 6/1953 | Sonnberger | 289/1.5 X |
| 2,888,854 | 6/1959 | Johnson | 289/1.2 X |

*Primary Examiner*—Louis K. Rimrodt

*Attorney, Agent, or Firm*—Lerner, David, Littenberg & Samuel

[57] ABSTRACT

A fishing net bearing tightly fastened knots free from loosening and a facilitative method for manufacturing the same which method comprises the steps of: holding either the warp or weft by an upper hook freely rotatable about its own axis; making the upper hook to rotate about its axis a half or one and a half; holding the other warp or weft; forming two loops consisting of the warp and weft respectively by making the upper hook to turn about its axis a full rotation; pulling the warp through said loops and passing it along the underside of a shuttle frame, causing the warp to draw the weft so as to bend it within the loops; releasing the loops of the warp and weft from the upper hook; and tightly fastening together said warp and weft to form a knot.

6 Claims, 19 Drawing Figures

METHOD FOR MANUFACTURING FISHING NET

BACKGROUND OF THE INVENTION

This invention relates to a finising net bearing tightly fastened knots and being free from the occurrence of mesh deformation, and a method for manufacturing the same.

Typical fishing nets known to date include the so-called weaver's knot net formed either by tightly winding a warp once about the loop portion (which, as used herein, is defined to mean also a bent portion approximating a ring) of a weft or by tightly winding a warp twice about the loop portion of a weft so as to provide a double knot net which is widely employed as a gill net.

However, said knot net of the prior art is sometimes liable to be loosened. This tendency is particularly noticeable where a fishing net is formed of rigid but slippery cords such as monofilaments of synthetic fiber. Where, therefore, a fishing net is manufactured from such material, it is indispensable to tightly fasten the knots again, or to apply a thermal setting treatment or resin treatment. Accordingly, the prior art fishing net consisting of synthetic resin monofilaments has the drawbacks that it not only requires such numerous additional steps before it is finished for practical application but also contains irregular knots or meshes. Referring to the conventional process of forming knots, warps wound about an upper hook are subject to ununiform tension and the loops of said warps are taken off the upper hook at the same time or irregularly, thus preventing the warp loops from being tightened always under the same condition.

For elimination of the above-mentioned difficulties, there have recently been devised fishing nets bearing knots of various types and constructions. However, the proposed fishing nets are accompanied with the shortcomings that they are not adapted for mechanical manufacture or that a machine for manufacturing such nets would be too much complicated to attain high productivity, and consequently are difficultly adopted in practical operation.

BRIEF SUMMARY OF THE INVENTION

This invention has been accomplished in view of the above-mentioned difficulties and is intended to provide a fishing net bearing tightly fastened knots free from loosening.

According to an aspect of this invention, there is provided a method of manufacturing a fishing net bearing knots consisting of a warp and weft which comprises holding either the warp or weft by an upper hook freely rotatable about its own axis; making the upper hook to rotate about its axis a half or one and a half; holding the other warp or weft; forming two loops consisting of the warp and weft respectively by making the upper hook to turn about its axis a full rotation; pulling the warp through said loops and passing it along the underside of a shuttle frame, causing the warp to draw the weft so as to bend it within the loops; taking the loops of the warp and weft off the upper hook; and tightly fastening together said warp and weft to form a knot.

BRIEF DESCRIPTION OF THE DRAWINGS

This invention can be more fully understood from the following detailed description when taken in connection with reference to the accompanying drawings, in which:

FIGS. 3A and 3B jointly show a knot formed by the sequential steps of FIG. 2, in which FIG. 3B presents the largely loosened condition of the knot of FIG. 3A;

DETAILED DESCRIPTION OF PREFERRED EMBODIMENTS

Figure 1:
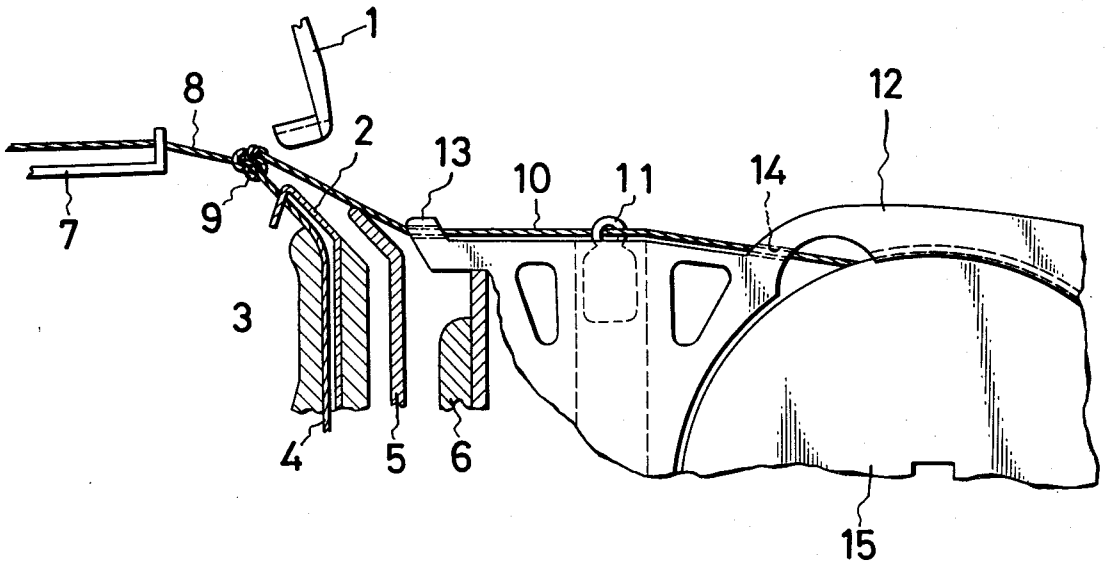
FIG. 1 is a schematic illustration of a fishing net manufacturing machine according to this invention.

There will now be described preferred embodiments of this invention with reference to the appending drawings. FIG. 1 schematically illustrates the section of a fishing net manufacturing machine which is used in forming the knots of the above-mentioned net. Referential numeral 1 denotes an upper hook which can be rotated clockwise or counter-clockwise on its own axis and also inclined to any prescribed extent. The upper hook 1 is provided at the bottom with a groove through which the later described lower hook passes. Behind the upper hook 1 is disposed a reed 7, and ahead thereof are positioned a shuttle frame 12 and a spool 15. Numeral 13 represents a guide hole bored at the forward end of the shuttle frame 12, 14 a guide hole formed in the upper part of the shuttle frame 12, 11 a weight and 6 a forward shuttle frame rest. Below the upper hook 1 are located an angle 3 and a guide hook 2 opposite thereto.

This invention is further characterized in that there is newly provided a weft lifting plate 5 between the guide hook 2 and the forward shuttle frame rest 6. FIG. 1 presents a knot 9 formed of a warp 8 and weft 10. To form a knot 9, part of the warp 8 is pulled by the later described lower hook through the loops of the warp 8 and the weft 10 already formed on the bent portion of the upper hook 1, passed over the shuttle frame 12, again conducted through said loops and finally pulled through the loops with the forward end portion of the weft 10 bent. The net cords thus knotted are made to travel downward through the guide hook 2 and angle 3.

There will now be described with reference to FIGS. 2A to 2G a sequential steps of forming the knot of a fishing net of this invention.

Step A: This is the initial stage of newly forming a knot for repeating the subsequent steps B to G.

Figure 2A:
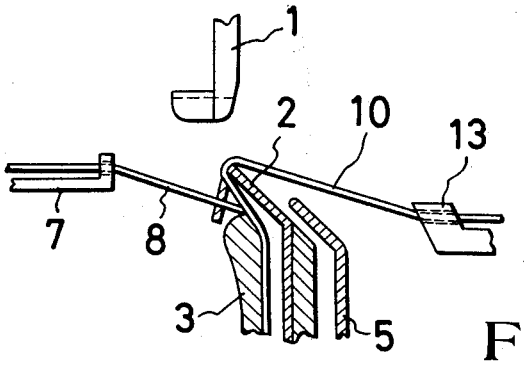
FIGS. 2A to 2G indicate the sequential steps for forming a knot of a fishing net according to an embodiment of the invention.
Figure 2B:
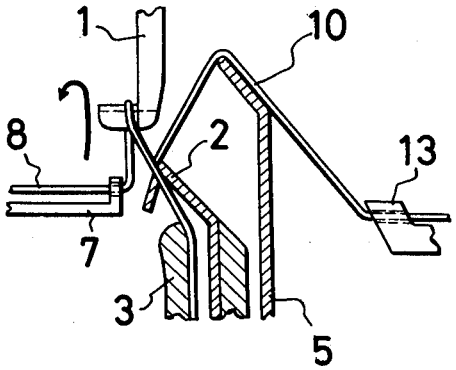
Figure 2C:
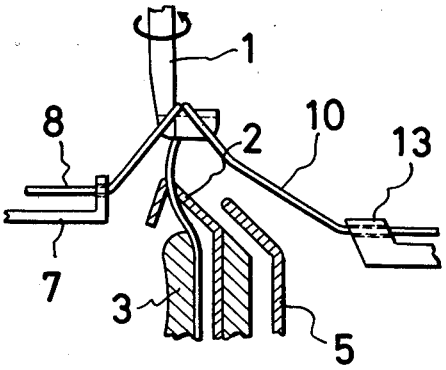
Figure 2D:
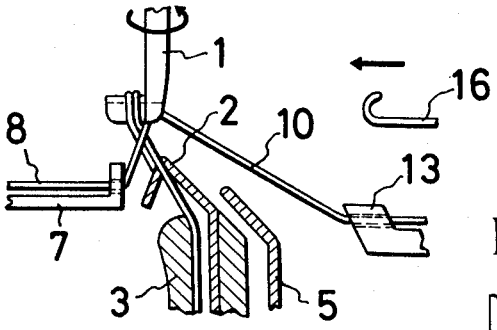
Figure 2E:
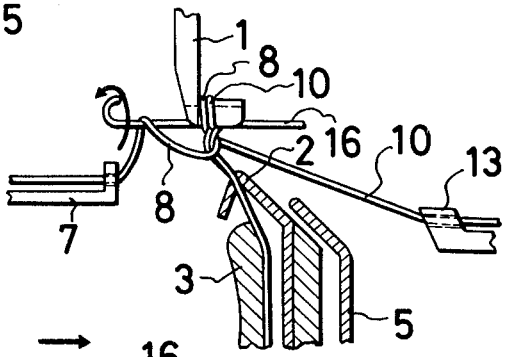
Figure 2F:
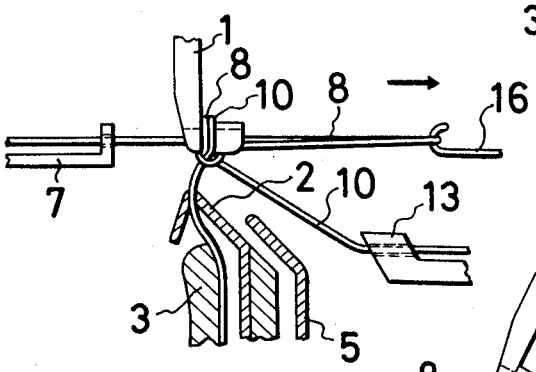
Figure 2G:
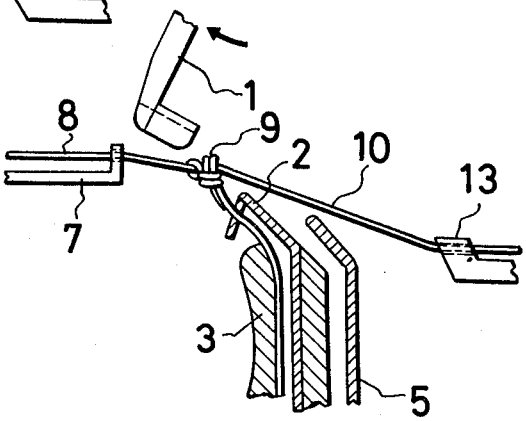

Step B: When the reed 7 advances, the warp 8 is caused to travels, as shown in FIG. 2B, from the back side to the front side over the bent portion of the upper hook 1 and passed downward while being held by said bent portion. On the other hand, the weft lifting plate 5 pushes the weft 10 up, ready for the succeeding step.

Step C: When the upper hook 1 makes half a rotation to the left, the weft 10 is caught by the bent portion of said upper hook 1. At this time, the weft lifting plate 5 is brought downward to its original position.

Step D: The upper hook 1 further makes half a rotation to the left. The warp 8 and weft 10 thus held by the bent portion of the upper hook 1 respectively form loops which are later fastened together into a knot with the forward end portion of the weft 10 bent.

Step E: The upper hook 1 further makes half a rotation to the left. On the other hand, a lower hook 16 advances to slide through a groove formed in the bent portion of the upper hook 1 and is brought to rest after passing through the loops. At this time, the reed 7 moves from the left side to the right side indicated in FIG. 2E beyond the lower hook 16, thereby causing the warp 8 to be caught by said lower hook 16. At this time the warp 8 is wound about the body of the lower hook 16 from the back side to the front side.

Step F: When the lower hook 16 is drawn backward, the warp 8 caught by the bent portion of the lower hook 16 is pulled by said lower hook 16 through the loops of both warp and weft already formed on the bent portion of the upper hook 1. The lower hook 16 retracts until the forward end portion of the warp 8 is drawn up to the rear end of the shuttle frame. At this point the warp 8 is released from the lower hook 16 and passes over the rear end of the shuttle frame 12 along its underside. After leaving the shuttle frame, the warp 8 is pulled backward to the upper hook 1 disposed at the forward part of the knot-forming machine, causing the weft 10 to pass through the loops of both warp 8 and weft 10 already formed on the bent portion of the upper hook 1, and be further drawn in a bent state.

Figure 3A:
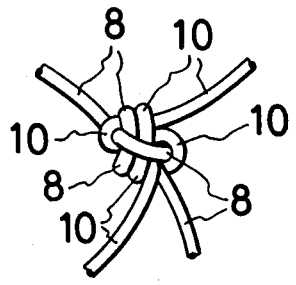
Figure 3B:
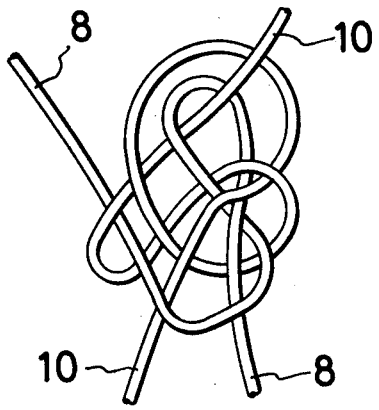
Figure 4A:
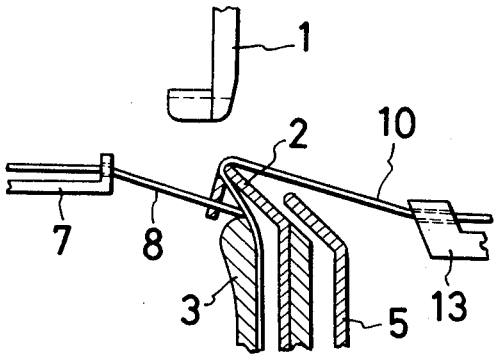
FIGS. 4A to 4G show the sequential steps for forming another knot of a fishing net according to another embodiment of the invention.
Figure 4B:
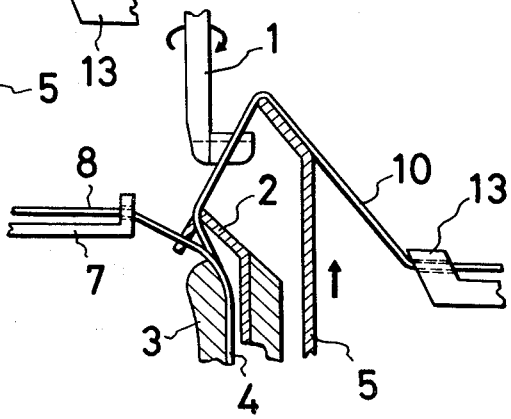
Figure 4C:
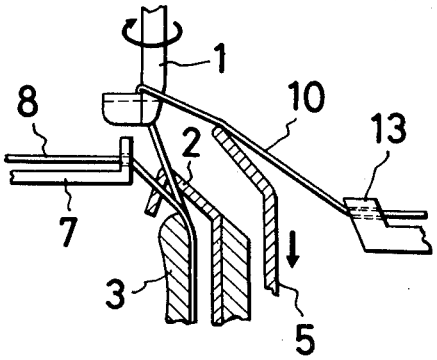
Figure 4D:
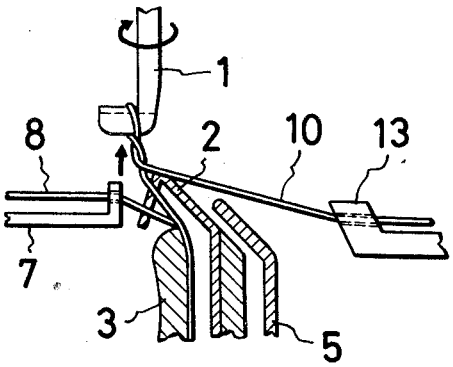
Figure 4E:
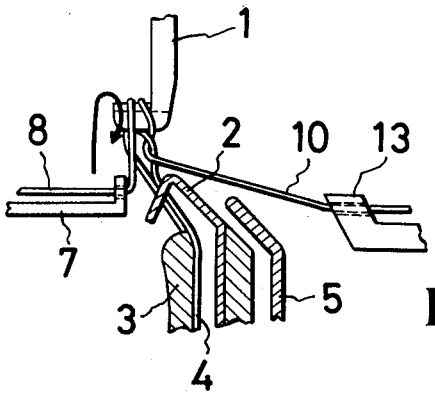
Figure 4F:
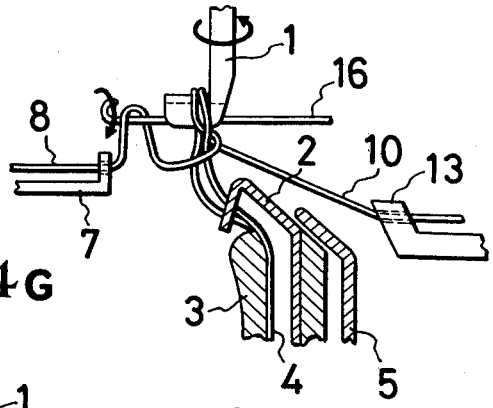
Figure 4G:
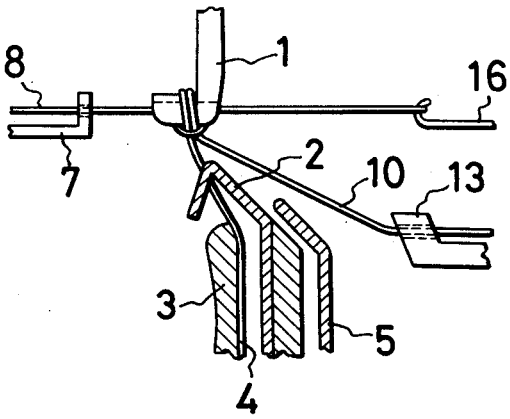

Step G: When the warp 8 is thus pulled backward and the weft 10 passes through the loops of both warp 8 and weft 10 already formed on the bent portion of the upper hook 1, said hook 1 is inclined to release the knot jointly formed by both warp 8 and weft 10 from said bent portion. Later the upper hook 1 makes half a rotation to the right or left back to its original position shown in Step A. The knot formed on the net cord through the above-mentioned Steps A to G is presented in FIG. 3A. FIG. 3B illustrates the largely loosened state of said knot.

There will now be described still another embodiment of this invention with reference to FIGS. 4A to 4G showing the sequential steps A to G forming a knot.

Step A: This is the initial step of forming a knot showing the regular positions of the warp 8, weft 10 and the components of a net manufacturing machine.

Step B: While the upper hook 1 makes half a rotation to the right, the weft lifting plate 5 is brought upward to catch the weft 10.

Step C: When the upper hook 1 further makes half a rotation to the right after holding the weft 10, the weft lifting plate 5 descends.

Step D: When the upper hook 1 further makes a full rotation to the right, the reed 7 rises.

Step E: The reed 7 further rises to throw the warp 8 about the bent portion of the upper hook 1 from the front side to the back side and thereafter is brought downward.

Step F: When the upper hook 1 further makes a full rotation to the right, the warp 8 and weft 10 held by the bent portion of the upper hook 1 respectively make loops and the lower hook 16 passes through the loops to the forward.

Step G: When the lower hook 16 retracts, the warp 8 thrown about the body of said hook 16 from the front side to the back side is pulled out of the reed 7 and passes through the loops of both warp 8 and weft 10 already formed on the bent portion of the upper hook 1 and then is drawn to the rear side. Thereafter the warp 8 is further pulled rearward up to the rear end of the shuttle frame 12. At this point the warp 8 is released from the lower hook 16 and passes over the rear end of the shuttle frame 12 along its underside. The warp 8 passing along the underside of the shuttle frame 12 is pulled into the loops of both warp 8 and weft 10 already formed on the bent portion of the upper hook 1 so as to bend the forward end portion of the weft 10. At this time, the upper hook 1 is inclined to release the loops of both warp 8 and weft 10 jointly. Thus is obtained a knot in which the weft 10 is fastened by the double loops. Thereafter the net cord is made to travel for the prescribed length of one mesh. After a knot is formed, the upper hook 1 makes a full rotation to the left to be brought back to its original position shown in Step A.

Figure 5A:
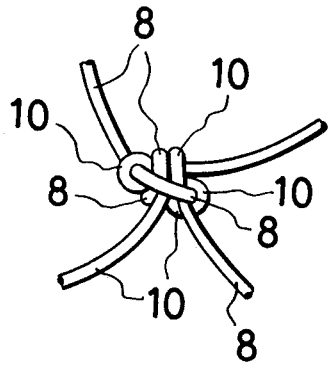
FIGS. 5A and 5B jointly present a knot formed by the sequential steps of FIG. 4 in which FIG. 5B indicates the largely loosened condition of the knot of FIG. 5A.
Figure 5B:
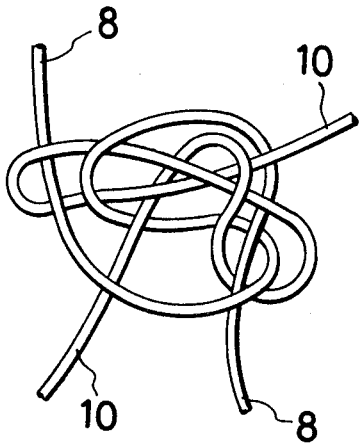

Repetition of the above-mentioned knot-forming operation provides a fishing net bearing knots illustrated in FIG. 5A. FIG. 5B shows the largely loosened state of the knot.

In the knots formed by the two preceding embodiments of this invention, the loops wound about the bent portion of the upper hook consist of a warp and weft unlike the conventional weaver's knot in which the loop is formed simply by winding a warp along twice about the bent portion of the upper hook. According to this invention, therefore, the warp and weft can retain a proper tensile strength and the loops formed thereby can be released from the bent portion of the upper hook, at the same time, thereby eliminating a harmful effect resulting from the irregular removal of loops from said bent portion as is often the case with the prior art knot-forming process. Further, the warp and weft are separately tightened, fully preventing resultant knots from presenting ununiform shapes. The rotating direction of the upper hook and the moving direction of the reed may be combined in various forms to change the manner in which the warp and weft are thrown or wound about the bent portion of the upper hook, thereby obtaining different types of knots.

As apparent from the foregoing description, the warp and weft constituting the knots of a fishing net manufactured by the method of this invention are so interlaced as to permit their separate tightening and be fastened together simply by tightening the knots while the net cord is made to travel through the fishing net-manufacturing machine. Accordingly, the knots formed on the fishing net of this invention are tightly fastened and least liable to be loosened, eliminating the occurrence of the deformation of meshes. As the result, there is no need thermally to set the net cord consisting of synthetic resin monofilaments or additionally treat said net cord with another type of resin. Therefore, the fishing net of this invention offers great economic advantage in this respect, too. Complete freedom of said fishing net from mesh deformation naturally admits of application of a wide range of synthetic resin monofilaments including nylon as the material of a fishing net cord. Moreover, the warp and weft interlaced by the method of this invention to form a knot are least liable to be broken, thus permitting the use of synthetic resin monofilaments having a smaller diameter than those required for the conventional knotted fishing net. This means that the present invention provides an optimum fishing net, where it is desired to increase a catch of fish by reducing a shade cast by a fishing net as in the case of the box section of a fixed fishing net.

From the practical standpoint, the knotted fishing net of this invention is characterized in that the meshes are uniformly opened wide, and, when used as a gill net, prominently elevates a catch. Speaking of the physical properties, the subject fishing net is found to withstand a 10% greater knot-breaking force and a 40% greater knot-shifting force and present a 10% greater impact strength. (As used herein, the term "knot-breaking force" means the magnitude of a force of pulling a net cord held at a knot in the opposite directions until said knot begins to be broken, and the term "knot-shifting force" means the magnitude of a force of pulling a net cord in one direction until a knot formed thereon begins to be displaced from its original position.) Therefore, the fishing net of this invention offers extremely great advantage in operation.

Table 1

Comparison of knotted fishing nets (in a dry state)
Specified grade: No. 8.5 with 118 m/m meshes

| Kind of knotted fishing net | Knot-breaking force (kg)* | Knot-shifting force (kg)* | Impact strength(kg)** |
|---|---|---|---|
| Conventional double knot net | 11.9 | 6.94 | 40.5 |
| Knotted net of this invention | 13.2 | 9.99 | 43.7 |

*These tests were carried out on a Schopper tensile machine.
**This test was effected on a pendulum impact testing machine.

I claim:

1. A method of manufacturing a fishing net including knots formed of a first warp member and a second weft member which comprises the following steps: holding either of the first and second members by an upper hook, said hook being freely rotatable about its own axis; moving the other of said first and second members into a position adjacent said upper hook; rotating said upper hook about its axis a half rotation or one and a half rotations to catch the other of said first and second members; rotating said upper hook about its axis a full rotation to form two loops from the first and second members; pulling the first warp member through said two loops and passing said first member along the underside of a shuttle frame, causing the first warp member to draw the second seft member through said two loops so as to bend it within said two loops; releasing said two loops of said first warp member and said second weft member from said upper hook; and tightly fastening together said first warp member and said second weft member to form a knot.

2. A method according to claim 1 wherein said full rotation is made after said half a rotation in the same direction as that of the latter rotation.

3. A method according to claim 1 wherein said full rotation is made after said half a rotation in the opposite direction to that of the latter rotation.

4. A method according to claim 1 wherein said full rotation is made after said one and a half rotations in the opposite direction to that of the latter rotations.

5. A method according to claims 1 wherein both first warp member and second weft member are thrown about the upper hook from the same side.

6. A method according to claims 1 wherein both first warp member and second weft member are thrown about the upper hook from the opposite sides.

* * * * *